US011927013B1

(12) United States Patent
Harris

(10) Patent No.: US 11,927,013 B1
(45) Date of Patent: Mar. 12, 2024

(54) SUPPORT FOR CONCRETE REINFORCING MEMBERS

(71) Applicant: T. J. Harris Company, Knoxville, TN (US)

(72) Inventor: Terry L Harris, Mascot, TN (US)

(73) Assignee: T. J. Harris Company, Knoxville, TN (US)

( * ) Notice: Subject to any disclaimer, the term of this patent is extended or adjusted under 35 U.S.C. 154(b) by 0 days.

(21) Appl. No.: 18/490,791

(22) Filed: Oct. 20, 2023

Related U.S. Application Data

(63) Continuation-in-part of application No. 29/911,162, filed on Aug. 30, 2023.

(51) Int. Cl.
*E04C 5/16* (2006.01)

(52) U.S. Cl.
CPC ..... *E04C 5/168* (2013.01)

(58) Field of Classification Search
CPC . E04C 5/16; E04C 5/166; E04C 5/167; E04C 5/168
See application file for complete search history.

(56) References Cited

U.S. PATENT DOCUMENTS

| | | | |
|---|---|---|---|
| 1,464,886 | A | 8/1923 | Snyder |
| 3,255,565 | A | 6/1966 | Menzel |
| 3,673,753 | A | 7/1972 | Anderson |

(Continued)

FOREIGN PATENT DOCUMENTS

| | | | |
|---|---|---|---|
| CA | 2252200 | C | 1/2004 |
| DE | 4137772 | A1 * | 5/1992 |

(Continued)

OTHER PUBLICATIONS

Pages from Hercules Rebar Chair website (https://herculeschair.com/) copied on Nov. 11, 2023, depicting products that have been on sale since at least as early as 2003.

*Primary Examiner* — Christine T Cajilig
(74) *Attorney, Agent, or Firm* — Luedeka Neely, P.C.

(57) ABSTRACT

A structure for supporting concrete reinforcement bars in an orthogonal relationship above a surface includes a base member having a central opening and first and second pairs of leg members extending upward at an angle from the base member on opposite sides of the central opening, wherein the first leg members are longer than the second leg members. Attached to shoulders of the first and second leg members are first and second cradles having opposing upper and lower sidewalls that form channels therebetween. The first and second cradles receive reinforcement bars that are retained within the cradles by retaining members protruding from the opposing sidewalls into the channels. A ridge extending from the base member has a central portion and first and second portions sloping down from the central portion toward the base member which form a channel for receiving a reinforcement bar. The structure also includes various upper and lower fillets and edge brace portions at various points on the upper and lower cradles, including fillets between the opposing upper and lower sidewalls and first and second leg members and edge brace portions between the outer edges and bottom edges of the opposing upper and lower sidewalls and first and second leg members.

22 Claims, 6 Drawing Sheets

(56) References Cited

U.S. PATENT DOCUMENTS

| | | | | |
|---|---|---|---|---|
| 3,693,310 | A | 9/1972 | Middleton | |
| 3,788,025 | A | 1/1974 | Holmes | |
| 4,060,954 | A | 12/1977 | Liuzza | |
| 4,110,951 | A | 9/1978 | Padrun | |
| 4,498,270 | A | 2/1985 | Ilukowicz | |
| 4,598,523 | A | 7/1986 | Tolliver | |
| 4,835,933 | A | 6/1989 | Yung | |
| 5,107,654 | A | 4/1992 | Leonardis | |
| 5,893,252 | A | 4/1999 | Hardy, Jr. et al. | |
| 6,276,108 | B1 | 8/2001 | Padrun | |
| 6,282,860 | B1 | 9/2001 | Ramirez | |
| 6,345,474 | B1 | 2/2002 | Triplett | |
| 6,354,054 | B1 | 3/2002 | Verelli et al. | |
| D483,246 | S | 12/2003 | McPherson | |
| 6,663,316 | B1 * | 12/2003 | Harris | E04C 5/167 404/136 |
| 6,722,097 | B2 | 4/2004 | Haslem et al. | |
| 6,732,484 | B1 | 5/2004 | Sotelo et al. | |
| 6,775,954 | B1 | 8/2004 | Sorkin | |
| 6,837,017 | B2 | 1/2005 | Hardy et al. | |
| 6,962,029 | B2 | 11/2005 | Lowery et al. | |
| 7,028,443 | B2 | 4/2006 | Bennett et al. | |
| 7,108,453 | B2 * | 9/2006 | Harris | E04C 5/168 404/136 |
| 2006/0099032 | A1 * | 5/2006 | Harris | E04C 5/20 404/135 |
| 2016/0069063 | A1 * | 3/2016 | Harvey | E04C 2/28 52/220.1 |

FOREIGN PATENT DOCUMENTS

| | | |
|---|---|---|
| JP | 9221878 | 8/1997 |
| JP | 1061109 | 3/1998 |

* cited by examiner

SUPPORT FOR CONCRETE REINFORCING MEMBERS

FIELD

This disclosure generally relates to the field of structures for supporting concrete reinforcing members. More particularly, this disclosure is directed to a chair for supporting two reinforcing bars in an orthogonal relationship as concrete is poured to form a concrete slab.

BACKGROUND

Reinforcement bars made of steel, glass fiber reinforced polymer, and other materials are typically used in concrete slabs and other concrete structures to provide structural support to the concrete. In slab applications, the bars are usually arranged in regular repeating patterns such as a rectangular lattice and are supported some distance above the ground or other surface on which the slab is to be poured. This configuration allows the concrete to flow under and around the lattice, thereby encapsulating the lattice when the concrete hardens.

Prior structures for supporting the lattice above the ground, also referred to as chairs, are lacking in several respects. In particular, prior chair designs do not possess sufficient structural integrity to withstand the combined weight of the reinforcing bars and concrete, do not allow for arrangement of the reinforcing bars prior to retention within the chairs, fail to provide stable support, and do not effectively retain the reinforcing bars to adequately keep them in the proper position as the concrete is poured. Additionally, some prior chairs have been difficult to use in that multiple pieces are required to capture the reinforcement bars. Further, many of the prior chair designs are difficult to fabricate, increasing the overall cost of the chair.

Accordingly, what is desired is a strong, easy-to-use, and low-cost structure for providing stable support for reinforcement bars in concrete slabs.

SUMMARY

The above and other needs are met by an apparatus for supporting reinforcement bars in a concrete structure.

In one embodiment, the apparatus comprises a base member having an upper surface, a pair of opposing first leg members extending upward from the upper surface of the base member, a pair of opposing second leg members extending upward from the upper surface of the base member, an upper cradle attached to the first leg members for receiving an upper reinforcement bar, and a lower cradle attached to the second leg members for receiving a lower reinforcement bar. A ridge is disposed between one of the first leg members and an adjacent one of the second leg members. The ridge extends upward from the upper surface of the base member and comprises a top edge having a central portion, a first portion and a second portion. The first portion slopes downward from the central portion at an angle relative to the upper surface of the base member and extends toward the adjacent first leg member. The second portion slopes downward at an angle relative to the upper surface of the base member and extends toward the adjacent second leg member.

The upper cradle of the apparatus includes a first upper bar-support member having a pair of opposing first upper sidewalls separated by an upper channel and a second upper bar-support member having a pair of opposing second upper sidewalls separated by the upper channel. The lower cradle includes a first lower bar-support member having a pair of opposing first lower sidewalls separated by a lower channel and a second lower bar-support member having a pair of opposing second lower sidewalls separated by the lower channel. One of the first lower sidewalls is attached to an adjacent one of the first upper sidewalls and another of the first lower sidewalls is attached to an adjacent one of the second upper sidewalls. One of the second lower sidewalls is attached to an adjacent one of the first upper sidewalls and another of the second lower sidewalls is attached to an adjacent one of the second upper sidewalls.

In some embodiments, the base member includes an outer edge defining four corners that are each positioned equidistantly from an adjacent one of the first leg members and an adjacent one of the second leg members, wherein the ridge is disposed adjacent to one of the four corners.

In some embodiments, the first portion of the top edge of the ridge is at a 90 degree angle relative to the second portion of the top edge of the ridge.

In some embodiments, the central portion of the top edge of the ridge defines a curved transition between the first and second portions of the top edge of the ridge.

In some embodiments, the upper cradle further comprises various additional supporting structures. In various exemplary embodiments, the upper cradle may include first upper fillets that connect the first upper sidewalls to an upper portion of a first one of the first leg members. In this manner, the first upper fillets and the upper portion of the first one of the first leg members define a first rounded surface for receiving a round reinforcing bar. The upper cradle may also include second upper fillets that connect the second upper sidewalls to an upper portion of a second one of the first leg members, such that the second upper fillets and the upper portion of the second one of the first leg members define a second rounded surface for receiving the round reinforcing bar.

In some embodiments, the lower cradle may also include first and second lower fillets. The first lower fillets connect the first lower sidewalls to an upper portion of a first one of the second leg members, such that the first lower fillets and the upper portion of the first one of the second leg members define a first rounded surface for receiving a round reinforcing bar. Similarly, the second lower fillets connect the second lower sidewalls to an upper portion of a second one of the second leg members, such that the second lower fillets and the upper portion of the second one of the second leg members define a second rounded surface for receiving the round reinforcing bar.

In some embodiments, each of the first and second leg members includes a foot portion extending outwardly from the base member.

In some embodiments of the above apparatus, the first leg members and second leg members extend upward from the upper surface of the base member at an angle ranging from about 73 degrees to about 85 degrees.

In some embodiments of the above apparatus, the base member, first and second leg members, ridge, upper cradle, and lower cradle all comprise a unitary structural element In some embodiments, the base member, first and second leg members, ridge, upper cradle, and lower cradle are all formed from a continuous piece of thermoplastic material.

Some embodiments are directed to an apparatus that includes a base member having a lower surface, an opposing upper surface, and a central opening. A pair of opposing first leg members extend upward from the upper surface of the base member and are disposed on opposing sides of the central opening. A pair of opposing second leg members extend upward from the upper surface of the base member and are disposed on opposing sides of the central opening and alternatingly disposed between the first leg members, wherein the second leg members are shorter than the first leg members. An upper cradle is attached to the first leg members for receiving an upper reinforcement bar, and a lower cradle is attached to the second leg members for receiving a lower reinforcement bar.

The upper cradle includes a first upper bar-support member having a pair of opposing and parallel first upper sidewalls separated by an upper channel. A second upper bar-support member has a pair of opposing and parallel second upper sidewalls separated by the upper channel. Each of the first upper sidewalls is substantially coplanar with one of the second upper sidewalls. The upper cradle further comprises upper retaining members that protrude inwardly from top edges of the opposing first and second upper sidewalls. The upper retaining members have an upper surface that slants downward at an angle with respect to the first and second upper sidewalls to guide and retain the upper reinforcement bar within the upper cradle.

The lower cradle comprises first and second lower bar-support members. The first lower bar-support member has a pair of opposing and parallel first lower sidewalls separated by a lower channel. One of the first lower sidewalls is attached to an adjacent one of the first upper sidewalls, and another of the first lower sidewalls is attached to an adjacent one of the second upper sidewalls. The second lower bar-support member has a pair of opposing and parallel second lower sidewalls separated by the lower channel. One of the second lower sidewalls is attached to an adjacent one of the first upper sidewalls, and another of the second lower sidewalls is attached to an adjacent one of the second upper sidewalls. Each of the first lower sidewalls is substantially coplanar with one of the second lower sidewalls. The lower cradle also includes lower retaining members that protrude inwardly from the top edges of the opposing first and second lower sidewalls. The lower retaining members have an upper surface slanting downward at an angle with respect to the first and second lower sidewalls to guide and retain the lower reinforcement bar within the lower cradle.

In some embodiments, the central opening of the base member is defined by an inner edge that forms a square having filleted corners.

In some embodiments, each of the upper and lower retaining members includes a lower surface that extends inwardly from each of the first and second upper and lower sidewalls.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 9:
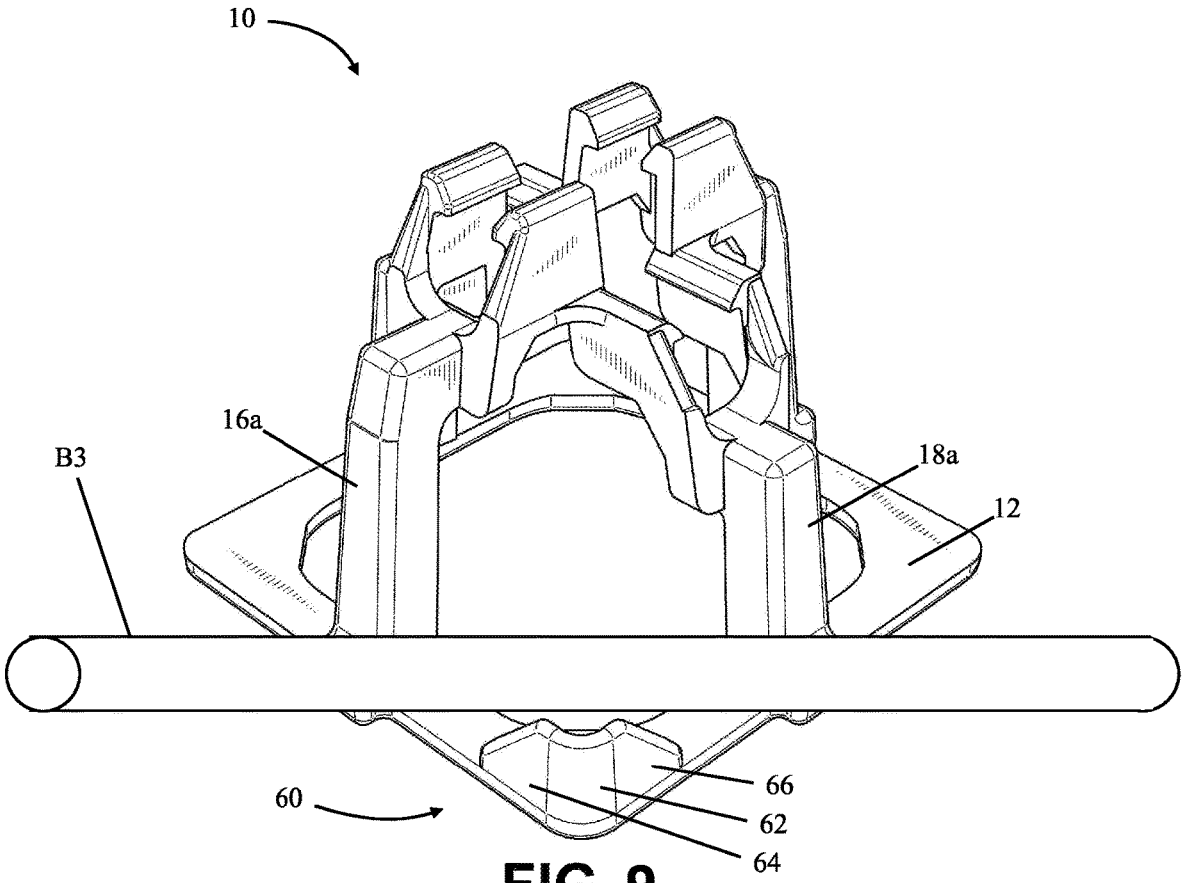
FIG. 9 depicts a structure for supporting concrete reinforcement bars with a diagonal reinforcement bar disposed thereon in accordance with one embodiment.
Figure 10:
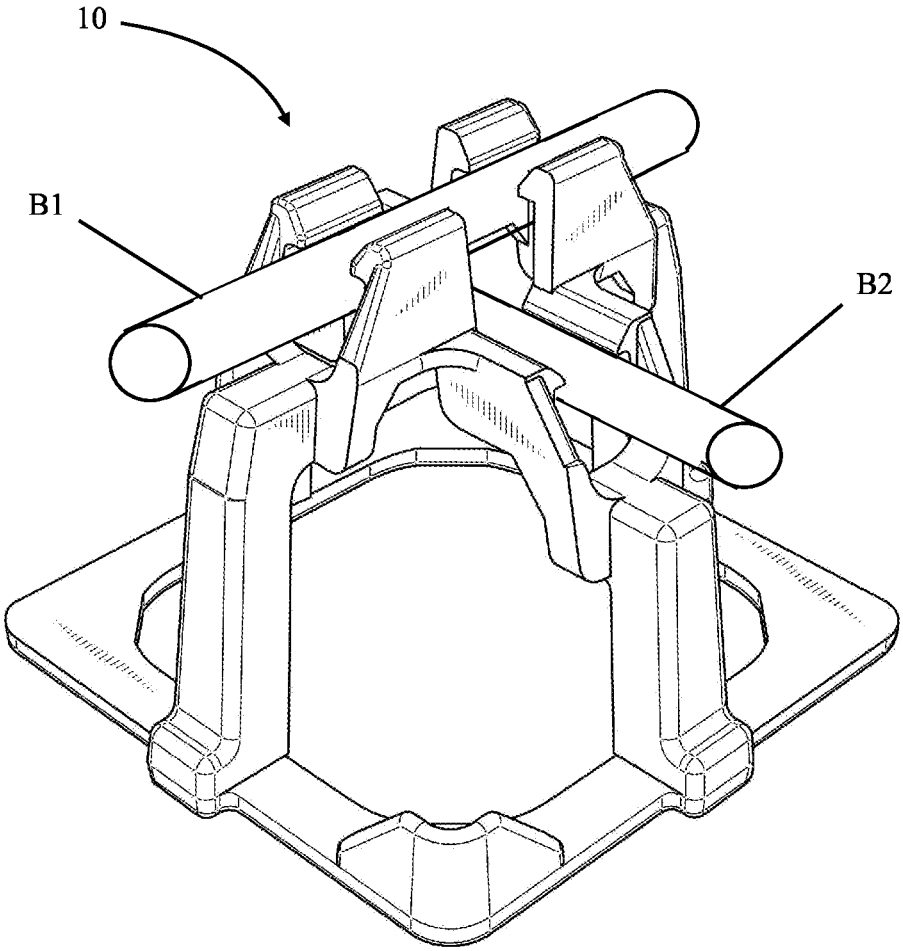
FIG. 10 depicts a structure for supporting concrete reinforcement bars with a two reinforcement bars supported thereon in accordance with one embodiment.

Depicted in FIGS. 1-10 is a structure 10 for supporting concrete reinforcement bars, also referred to herein as a re-bar "chair." As shown in FIG. 10, the chair 10 may be used to hold concrete reinforcement bars B1 and B2 in a substantially orthogonal relationship as concrete is poured around the chair 10 and the bars B1 and B2 to form a concrete structure. As one skilled in the art will appreciate, many such chairs 10 may be used to support a rectangular lattice of reinforcement bars in a concrete slab.

The chair 10 includes a base member 12 preferably having an outer edge 13 forming a shape having one or more corners 14—preferably four corners 14—thus forming a rectangle or square, but which also could be circular, octagonal, or other shape. Within the base member 12, there is preferably an opening 15. Preferably, the opening 15 is defined by an inner edge 21 forming a square having filleted inner corners 23, which operates to provide the chair 10 with a larger footprint as the chair 10 is submerged in concrete, effectively stabilizing the chair 10 and preventing the lattice of reinforcing bars from shifting with the flow of the concrete. Situated around the opening 15 are a set of leg members, including opposing long leg members 16*a* and 16*b* and opposing short leg members 18*a* and 18*b*. The leg members 16*a-b* and 18*a-b* are attached at their lower extremities to the base member 12 and extend therefrom, preferably at an angle ranging from about 73 degrees to about 85 degrees for increased strength.

Preferably, one or more of the leg members 16*a-b* and 18*a-b* further includes a foot portion 11 extending outwardly from the base member 12 at the attachment point between the base member 12 and the lower extremities of the leg members 16*a-b* and 18*a-b*. In some embodiments, the foot portion 11 may extend outwardly beyond the outer edge 13 of the base member 12. The foot portion 11 provides increased stabilization to the structure 10 and reinforces the attachment points between the base member 12 and leg members 16*a-b* and 18*a-b*, which frequently bear great stresses as the chair 10 is loaded with concrete reinforcement bars and submerged in concrete. The leg members 16*a-b* and 18*a-b* of the preferred embodiment are generally rectangular in cross-section and may be somewhat thicker at their lower extremities than at their upper extremities. Preferably, each corner 14 is positioned equidistantly from adjacent alternating leg members 16*a-b* and 18*a-b*.

In addition to long and short leg members 16*a-b* and 18*a-b* extending upward from base member 12, the chair 10 further includes a ridge 60 extending upward from the base member 12. The ridge 60 is disposed at a corner 14 of the base member 12 between and equidistant from one of the long leg members and one of the short leg members. The ridge 60 comprises three portions extending upward from the base member 12 at various heights, including a central portion 62, a first portion 64, and a second portion 66. The central portion 62 serves as a connection point between the first portion 64 and the second portion 66 and extends further above the base member 12 than either the first portion 64 or the second portion 66. Additionally, the top edge of the central portion 62 may be curved, such that the central portion 62 defines a curved transition between the first portion 64 and the second portion 66 along the top edge of the ridge 60. Both the first portion 64 and the second portion 66 extend downward from the central portion 62 at an angle relative to the upper surface of the base member 12. The first portion 64 extends downward along the base member 12 toward the adjacent long leg member 16*a*, while the second portion 66 extends downward along the base member 12 toward the adjacent short leg member 18*a*, thus forming an angle between the first portion 64 and second portion 66. Preferably, the angle formed between the first portion 64 and second portion 66 is about 90 degrees.

In use, the ridge 60 may be used to hold a rectangular lattice of reinforcement bars in place as users lay out the lattice in preparation for pouring the concrete. As shown in FIG. 9, users are able to arrange reinforcing bars B3 within the spaces between the second portion 66 and the adjacent short leg member 18*a* and between the first portion 64 and the long leg member 16*a* such that the chairs 10 are at an angle relative to their normal use positions (in which reinforcing bars are placed into the channels of the chair 10). Thus, the ridge 60 can be used as a guide, allowing users to space chairs 10 apart without snapping the reinforcing bars in. This preliminary arrangement prevents waste in the case of users who might otherwise use too many chairs 10 and thus too many reinforcing bars for the particular application and prevents failure in the case of users who might otherwise use too few chairs 10 and thus too few reinforcing bars to provide inadequate support for the concrete slab.

Figure 1:
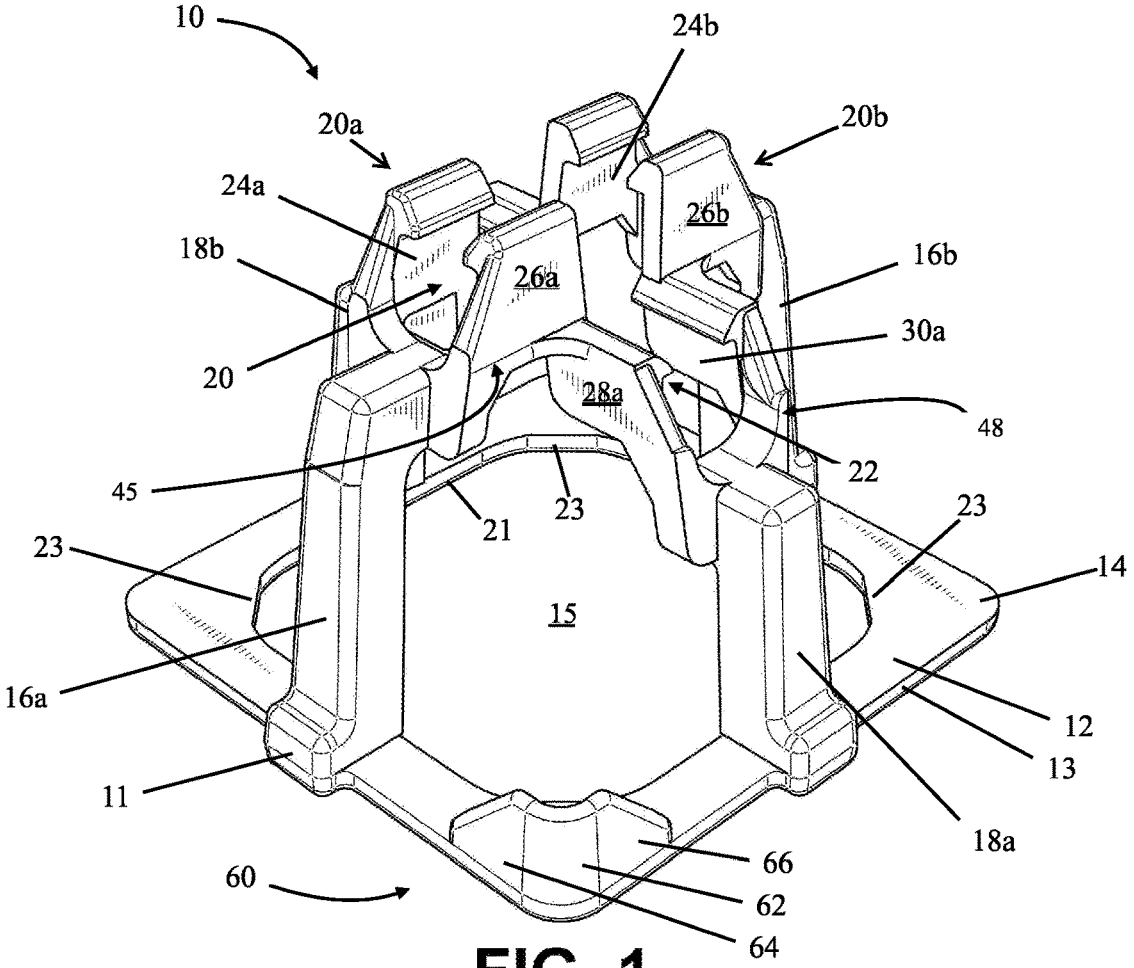
FIG. 1 is a top perspective view of a structure for supporting concrete reinforcement bars in accordance with one embodiment of the present disclosure.
Figure 2:
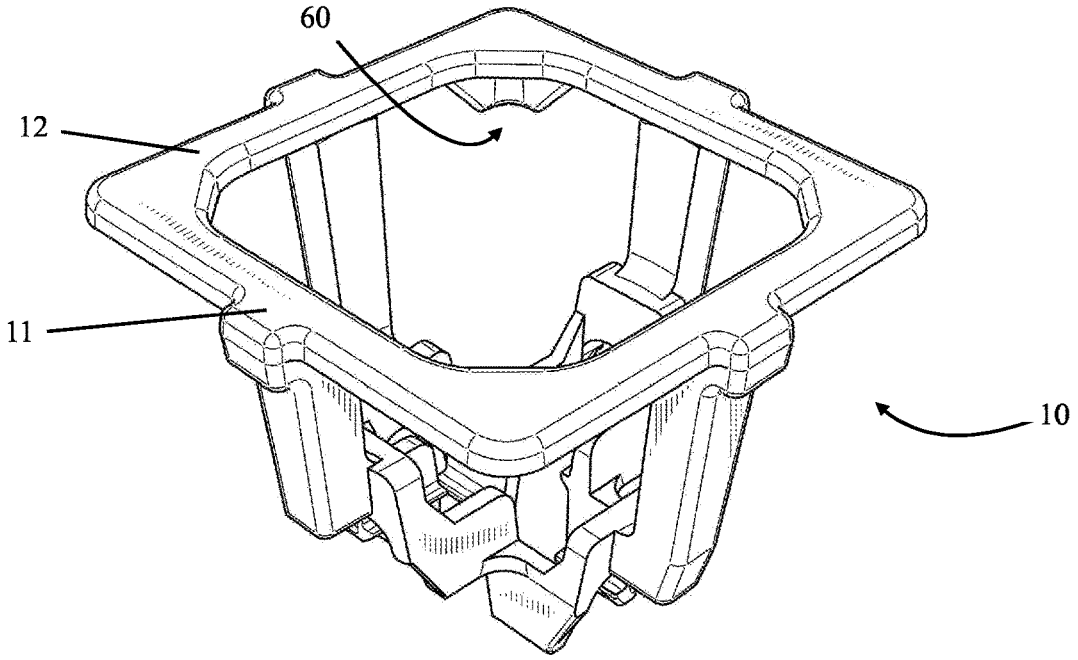
FIG. 2 is a bottom perspective view of a structure for supporting concrete reinforcement bars in accordance with one embodiment.
Figure 3:
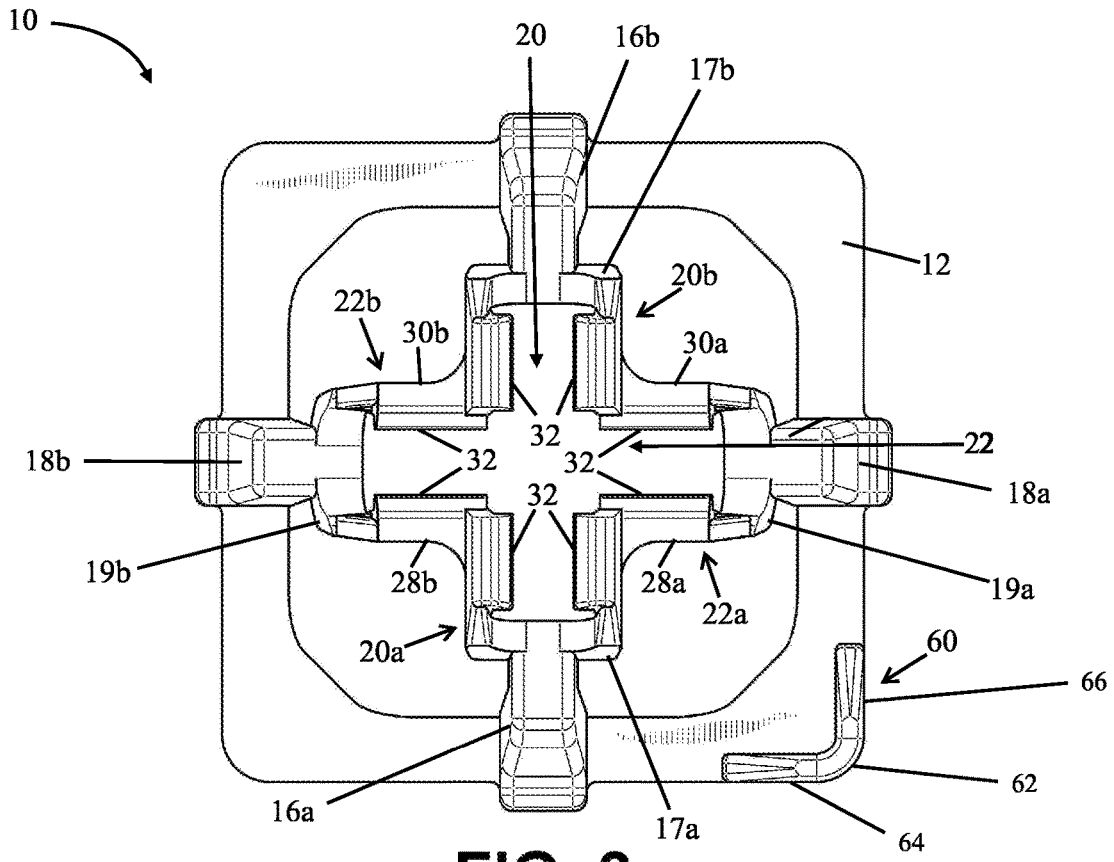
FIG. 3 is a top plan view of a structure for supporting concrete reinforcement bars in accordance with one embodiment.
Figure 4:
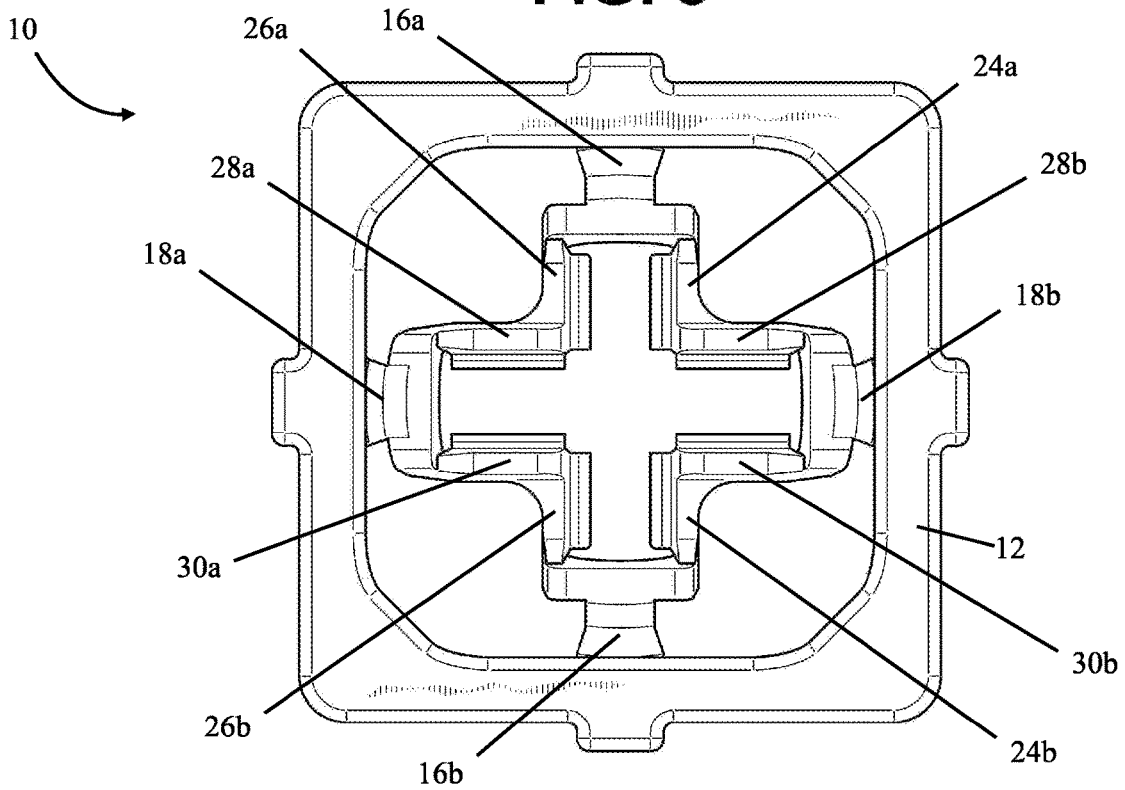
FIG. 4 is a bottom plan view of a structure for supporting concrete reinforcement bars in accordance with one embodiment.

As shown in FIGS. 1 and 3, attached to the upper extremity of the long leg member 16*a* is a first upper bar-support member 20*a*, and attached to the upper extremity of the long leg member 16*b* is a second upper bar-support member 20*b*. The upper bar-support members 20*a-b* are preferably attached to the long leg members 16*a-b* via upper shoulder members 17*a-b* extending horizontally outwardly from upper extremities of the long leg members 16*a-b*. The first upper bar-support member 20*a* includes opposing sidewalls 24*a* and 26*a* that together form an upper channel C1 therebetween. Similarly, the second upper bar-support member 20*b* includes opposing sidewalls 24*b* and 26*b*.

Attached to the upper extremity of the short leg member 18*a* is a first lower bar-support member 22*a*, and attached to the upper extremity of the short leg member 18*b* is a second lower bar-support member 22*b*. The lower bar-support members 22*a-b* are preferably attached to the short leg members 18*a-b* via lower shoulder members 19*a-b* extending horizontally outwardly from upper extremities of the short leg members 18*a-b*. The first lower bar-support member 22*a* includes opposing sidewalls 28*a* and 30*a*, which together form a lower channel C2 therebetween. Similarly, the second lower bar-support member 22*b* includes opposing sidewalls 28*b* and 30*b*.

The sidewall 26*a* of the first upper bar-support member 20*a* is preferably attached to the sidewall 28*a* of the first lower bar-support member 22*a*, and the sidewall 24*a* of the first upper bar-support member 20*a* is attached to the sidewall 28*b* of the second lower bar-support member 22*b*. Similarly, the sidewall 26*b* of the second upper bar-support member 20*b* is attached to the sidewall 30*a* of the first lower bar-support member 22*a*, and the sidewall 24*b* of the second upper bar-support member 20*b* is attached to the sidewall 30*b* of the second lower bar-support member 22*b*. Based on this arrangement, the lower bar-support members 22*a* and 22*b* form a lower cradle 22 for receiving a lower reinforcement bar, and the upper bar-support members 20*a* and 20*b* form an upper cradle 20 for receiving an upper reinforcement bar.

Figure 5:
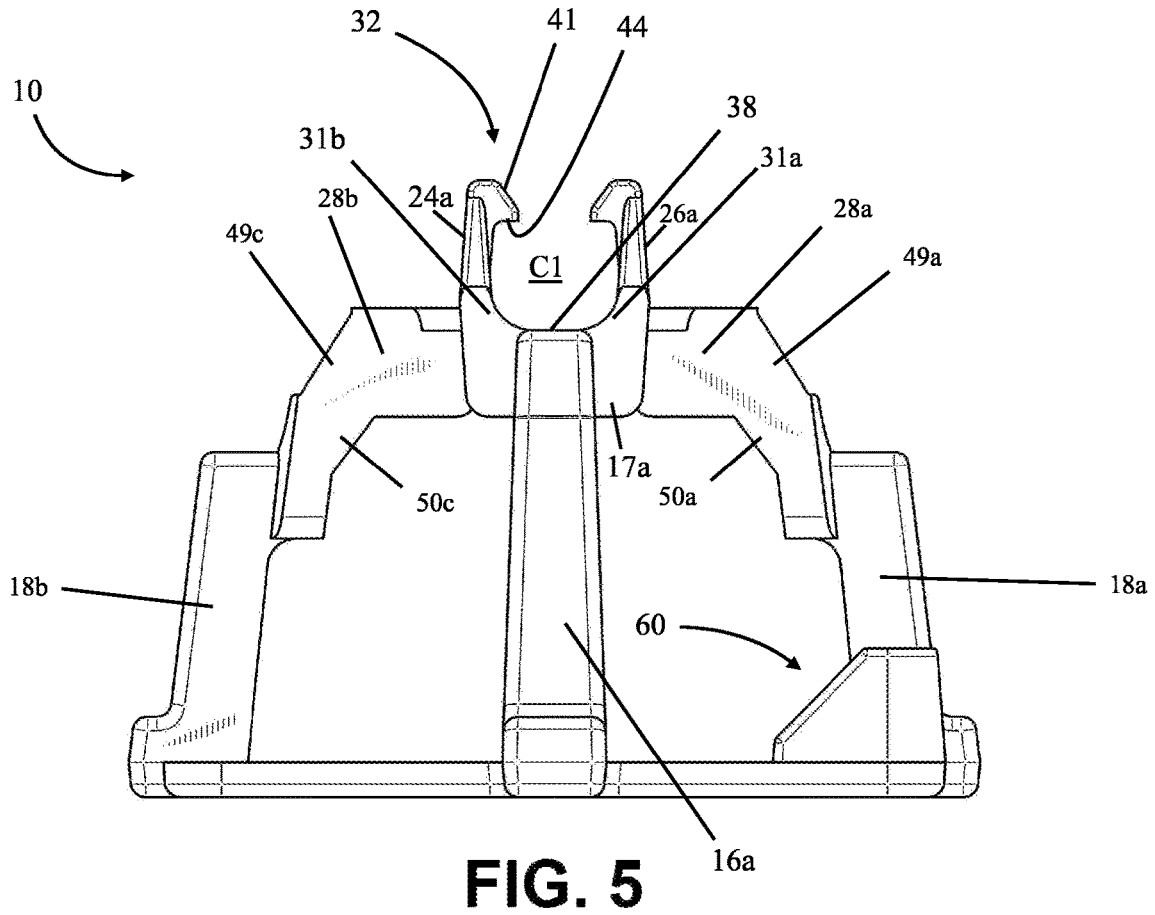
FIG. 5 is a first side view of a structure for supporting concrete reinforcement bars in accordance with one embodiment.
Figure 6:
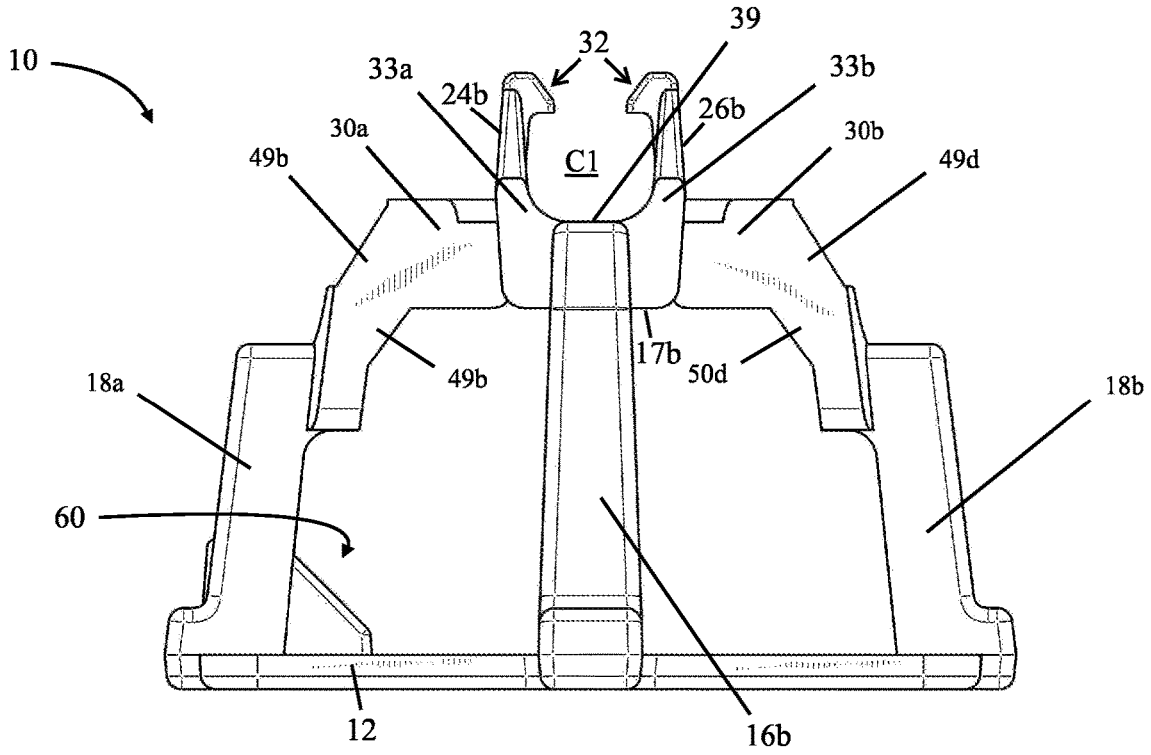
FIG. 6 is a second side view of a structure for supporting concrete reinforcement bars in accordance with one embodiment o.
Figure 7:
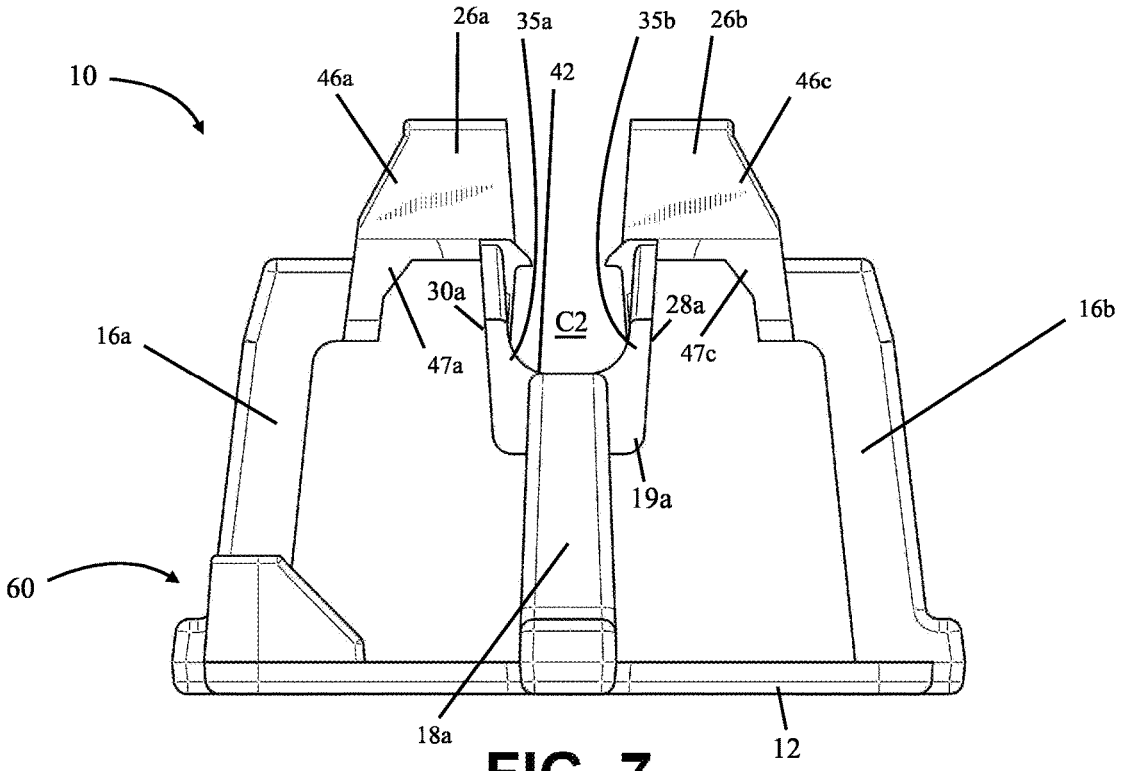
FIG. 7 is a third side view of a structure for supporting concrete reinforcement bars in accordance with one embodiment.
Figure 8:
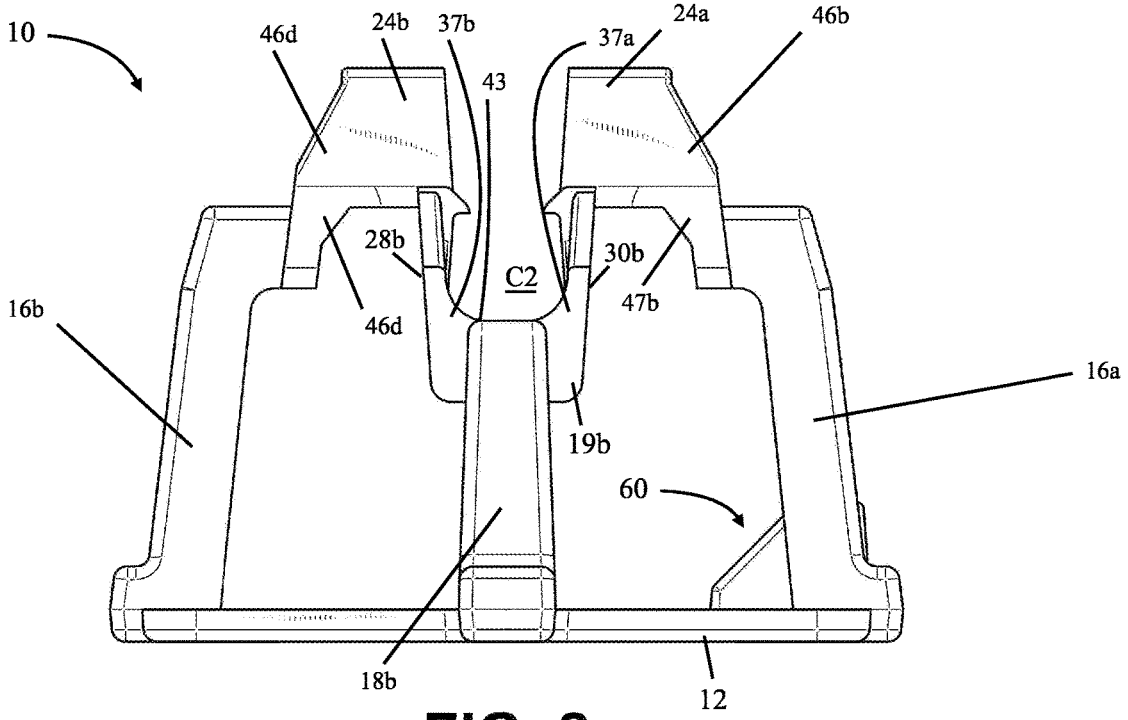
FIG. 8 is a fourth side view of a structure for supporting concrete reinforcement bars in accordance with one embodiment.

Preferably, the upper cradle 20 and lower cradle 22 also include various upper fillets and lower fillets that connect and reinforce various portions of the cradles in order to provide strength and stability to the chair 10 as it is loaded with concrete reinforcement bars B1 and B2 and submerged in concrete. As shown in FIGS. 5-7, upper fillets 31*a* and 31*b* connect the sidewalls 24*a* and 26*a* to the upper shoulder 17*a* at the upper extremity of the long leg member 16*a*, thereby forming a first upper rounded surface 38 for receiving a round reinforcing bar. Upper fillets 33*a* and 33*b* connect the sidewalls 24*b* and 26*b* to the upper shoulder 17*b* at the upper extremity of the long leg member 16*b*, thereby forming a second upper rounded surface 39 for receiving a round reinforcing bar. Likewise, lower fillets 35*a* and 35*b* connect the sidewalls 30*a* and 28*a* to the lower shoulder 19*a* at the upper extremity of the short leg member 18*a*, thereby forming a first lower rounded surface 42 for receiving a round reinforcing bar. Lower fillets 37*a* and 37*b* connect the sidewalls 30*b* and 28*b* to the lower shoulder 19*b* at the upper extremity of the short leg member 18*b*, thereby forming a second lower rounded surface 43 for receiving a round reinforcing bar. In addition to reinforcing and stabilizing high stress points in the chair 10, the first and second upper and lower rounded surfaces 38, 39, 42, and 43 all ensure that the reinforcing bars themselves, which are typically cylindrically shaped, fit more snugly into place within the upper cradle 20 and lower cradle 22. Thus, the rounded surfaces 38, 39, 42 and 43 further stabilize the chair 10 when it is loaded with reinforcing bars and concrete.

Preferably, the upper cradle 20 and lower cradle 22 also include upper edge brace portions and lower edge brace portions that connect the upper sidewalls 24*a-b* and 26*a-b* and the lower sidewalls 28*a-b* and 30*a-b* to the first and second shoulder members 17*a-b* and 19*a-b*, respectively. Shown in FIGS. 5-7, the upper cradle 20 includes first upper edge brace portions 46*a*, 46*b*, 46*c* and 46*d* that connect the outer edges of sidewalls 26*a* and 24*a* to upper shoulder member 17*a* and the outer edges of sidewalls 26*b* and 24*b* to upper shoulder member 17*b*, respectively. The upper cradle 20 further includes second upper edge brace portions 47*a*, 47*b*, 47*c* and 47*d* that connect the lower edges of sidewalls 26*a* and 24*a* to upper shoulder member 17*a* and the lower edges of sidewalls 26*b* and 24*b* to upper should member 17*b*, respectively. Likewise, the lower cradle 22 includes first lower edge brace portions 49*a*, 49*b*, 49*c* and 49*d* that connect the outer edges of sidewalls 30*a* and 28*a* to lower shoulder member 19*a* and the outer edges of sidewalls 30*b* and 28*b* to lower shoulder member 19*b*, respectively. The lower cradle 22 further includes second lower edge brace portions 50*a*, 50*b*, 50*c* and 50*d* that connect the lower edges of sidewalls 30*a* and 28*a* to lower shoulder member 19*a* and the lower edges of sidewalls 30*b* and 28*b* to lower should member 19*b*, respectively. The first and second upper and lower edge brace portions provide additional material to reinforce and stabilize high stress points, effectively creating a resilient transitional area capable of withstanding the enormous weight of the reinforcing bars and concrete.

Preferred embodiments include retaining members 32 that are disposed on the inner surfaces of the opposing sidewalls 24*a*-26*a*, 24*b*-26*b*, 28*a*-30*a* and 28*b*-30*b*. The retaining members 32 extend slightly over the channels C1 and C2 to prevent the reinforcement bars from lifting out of the upper and lower cradles 20 and 22. Each of the retaining members 32 includes an upper surface 41 extending downward at an angle from the top edges of opposing sidewalls 24*a*-26*a*, 24*b*-26*b*, 28*a*-30*a*, and 28*b*-30*b*. The retaining members 32 also preferably include a lower surface 44 extending slightly over the channels C1 and C2 from an inner surface of the opposing sidewalls 24*a*-26*a*, 24*b*-26*b*, 28*a*-30*a*, and 28*b*-30*b*. Thus, the opposing retaining members 32 both smoothly guide the reinforcing bars by virtue of the upper surface 41 and retain the reinforcing bars within the upper and lower cradles 20 and 22 by virtue of the lower surface 44, thereby preventing movement and stabilizing the chair 10. As the reinforcing bars are pressed downward into the channels C1 and C2, force is effectively transferred outward by the upper surface 41 to cause the sidewalls 24*a*-*b*, 26*a*-*b*, 28*a*-*b* and 30*a*-*b* to flex slightly outward and allow the reinforcement bars to snap into the channels C1 and C2. The lower surfaces 44 of the retaining members 32 extend squarely into the channels C1 and C2 and preferably have square or barbed corners for effectively capturing the reinforcement bars within the channels C1 and C2. Compared to prior chair designs that have used opposing tapered slots in a conical or cylindrical wall, the opposing sidewalls 24*a*-26*a*, 24*b*-26*b*, 28*a*-30*a* and 28*b*-30*b* and the retaining members 32 of the present invention provide a significantly improved retention mechanism.

In the preferred embodiment of the invention, all of the components of the chair 10 are formed from one continuous piece of thermoplastic, such as polypropylene, which, though rigid enough to support the weight of the reinforcement bars, is flexible enough to allow the sidewalls 24*a*-*b*, 26*a*-*b*, 28*a*-*b* and 30*a*-*b* to flex outward to receive the reinforcement bars as described above. Thus, when a reinforcement bar is laid across the cradle 20 on top of the retaining members 32 and is pressed downward, the sidewalls 24*a*-*b* and 26*a*-*b* may flex outward to allow the reinforcement bar to slide past the retaining members 32 and snap into place in the channel C1. Similarly, when a reinforcement bar is laid across the cradle 22 on top of the retaining members 32, and is pressed downward, the sidewalls 28*a*-*b* and 30*a*-*b* may flex outward to allow the reinforcement bar to slide past the retaining members 32 and snap into place in the channel C2. Of course, if the chair 10 is used to support two orthogonal reinforcement bars, the lowermost bar must be snapped into the lower cradle 22 first, and then the uppermost bar may be snapped into the upper cradle 20.

As one skilled in the art will appreciate, the chair 10 as depicted in the figures is designed to be formed using an injection molding process in a two-piece injection mold. For compatibility with a two-piece mold, the leg members 16*a*-*b* and 18*a*-*b* preferably lean slightly inward and have cross-sections which are preferably tapered from thicker to thinner from the lower to the upper extremities.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. An apparatus for supporting reinforcement bars in a concrete structure, the apparatus comprising:

a base member having an upper surface;

a pair of opposing first leg members extending upward from the upper surface of the base member;

a pair of opposing second leg members extending upward from the upper surface of the base member, the second leg members alternatingly disposed between the first leg members;

a ridge extending upward from the upper surface of the base member and disposed between an adjacent first leg member and an adjacent second leg member, the ridge comprising a top edge having:

a central portion;

first portion sloping downward from the central portion at an angle relative to the upper surface of the base member and extending toward the adjacent first leg member; and a second portion sloping downward at an angle relative to the upper surface of the base member and extending toward the adjacent second leg member, the second portion disposed at an angle to the first portion;

an upper cradle attached to the first leg members for receiving an upper reinforcement bar, the upper cradle comprising:

a first upper bar-support member having a pair of opposing first upper sidewalls separated by an upper channel; and a second upper bar-support member having a pair of opposing second upper sidewalls separated by the upper channel; and a lower cradle attached to the second leg members for receiving a lower reinforcement bar, the lower cradle comprising:

a first lower bar-support member having a pair of opposing first lower sidewalls separated by a lower channel, one of the first lower sidewalls attached to an adjacent one of the first upper sidewalls, and another of the first lower sidewalls attached to an adjacent one of the second upper sidewalls; and a second lower bar-support member having a pair of opposing second lower sidewalls separated by the lower channel, one of the second lower sidewalls attached to an adjacent one of the first upper sidewalls, and another of the second lower sidewalls attached to an adjacent one of the second upper sidewalls.

2. The apparatus of claim 1 wherein the base member has an outer edge defining four corners, each corner positioned equidistantly from an adjacent one of the first leg members and an adjacent one of the second leg members, and wherein the ridge is disposed adjacent to one of the four corners.

3. The apparatus of claim 1 wherein the first portion of the top edge of the ridge is at a 90 degree angle relative to the second portion of the top edge of the ridge.

4. The apparatus of claim 1 wherein the central portion of the top edge of the ridge defines a curved transition between the first and second portions of the top edge of the ridge.

5. The apparatus of claim 1 wherein the upper cradle further comprises:

first upper fillets that connect the first upper sidewalls to an upper portion of a first one of the first leg members, wherein the first upper fillets and the upper portion of the first one of the first leg members define a first rounded surface for receiving a round reinforcing bar; and second upper fillets that connect the second upper sidewalls to an upper portion of a second one of the first leg members, wherein the second upper fillets and the upper portion of the second one of the first leg members define a second rounded surface for receiving the round reinforcing bar.

6. The apparatus of claim 1 wherein the lower cradle further comprises:

first lower fillets that connect the first lower sidewalls to an upper portion of a first one of the second leg members, wherein the first lower fillets and the upper portion of the first one of the second leg members define a first rounded surface for receiving a round reinforcing bar; and second lower fillets that connect the second lower sidewalls to an upper portion of a second one of the second leg members, wherein the second lower fillets and the upper portion of the second one of the second leg members define a second rounded surface for receiving the round reinforcing bar.

7. The apparatus of claim 1 wherein each of the first and second leg members includes a foot portion that extends outwardly from the base member where each of the first and second leg members is connected to the base member.

8. The apparatus of claim 1 wherein the first leg members and second leg members extend upward from the upper surface of the base member at an angle that ranges from about 73 degrees to about 85 degrees.

9. The apparatus of claim 1 wherein the base member, first and second leg members, ridge, upper cradle, and lower cradle comprise a unitary structural element.

10. The apparatus of claim 1 wherein the base member, first and second leg members, ridge, upper cradle, and lower cradle are formed from a continuous piece of thermoplastic material.

11. An apparatus for supporting reinforcement bars in a concrete structure, the apparatus comprising:

a base member having a lower surface, an opposing upper surface, and a central opening;

a pair of opposing first leg members extending upward from the upper surface of the base member, the first leg members disposed on opposing sides of the central opening;

a pair of opposing second leg members extending upward from the upper surface of the base member, the second leg members disposed on opposing sides of the central opening and alternatingly disposed between the first leg members, the second leg members shorter than the first leg members;

an upper cradle attached to the first leg members for receiving an upper reinforcement bar, the upper cradle comprising:

a first upper bar-support member having a pair of opposing and parallel first upper sidewalls separated by an upper channel, each first upper sidewall having a top edge, a second upper bar-support member having a pair of opposing and parallel second upper sidewalls separated by the upper channel, each second upper sidewall having a top edge, wherein each of the first upper sidewalls is substantially coplanar with one of the second upper sidewalls, and upper retaining members protruding inwardly from the top edges of the opposing first and second upper sidewalls, the upper retaining members having an upper surface slanting downward at an angle with respect to the first and second upper sidewalls to guide and retain the upper reinforcement bar within the upper cradle;

a lower cradle attached to the second leg members for receiving a lower reinforcement bar, the lower cradle comprising:

a first lower bar-support member having a pair of opposing and parallel first lower sidewalls separated by a lower channel, one of the first lower sidewalls attached to an adjacent one of the first upper sidewalls, and another of the first lower sidewalls attached to an adjacent one of the second upper sidewalls, each first lower sidewall having a top edge, a second lower bar-support member having a pair of opposing and parallel second lower sidewalls separated by the lower channel, one of the second lower sidewalls attached to an adjacent one of the first upper sidewalls, and another of the second lower sidewalls attached to an adjacent one of the second upper sidewalls, each second lower sidewall having a top edge, wherein each of the first lower sidewalls is substantially coplanar with one of the second lower sidewalls, and lower retaining members protruding inwardly from the top edges of the opposing first and second lower sidewalls, the lower retaining members having an upper surface slanting downward at an angle with respect to the first and second lower sidewalls to guide and retain the lower reinforcement bar within the lower cradle; and a ridge extending upward from the upper surface of the base member and disposed between an adjacent first leg member and an adjacent second leg member, the ridge comprising a top edge having:

a central portion;

a first portion sloping downward from the central portion at an angle relative to the upper surface of the base member and extending toward the adjacent first leg member; and a second portion sloping downward at an angle relative to the upper surface of the base member and extending toward the adjacent second leg member, the second portion disposed at an angle to the first portion.

12. The apparatus of claim 11 wherein the central opening of the base member is defined by an inner edge that forms a square having filleted corners.

13. The apparatus of claim 11 wherein the each of the upper and lower retaining members further comprise a lower surface that extends inwardly from each the first and second upper and lower sidewalls.

14. The apparatus of claim 11 wherein the base member, first and second leg members, ridge, upper cradle, and lower cradle comprise a unitary structural element.

15. The apparatus of claim 11 wherein the base member, first and second leg members, ridge, upper cradle, and lower cradle are formed from a continuous piece of thermoplastic material.

16. An apparatus for supporting reinforcement bars in a concrete structure, the apparatus comprising:

a base member having an upper surface;

a pair of opposing first leg members each extending upwardly from the upper surface of the base member, each of the first leg members having a top portion and a first shoulder member extending horizontally from either side of the top portion of each of the first leg members;

a pair of opposing second leg members extending upward from the upper surface of the base member, the second leg members alternatingly disposed between the first leg members, each of the second leg members having a top portion and a second shoulder member extending horizontally from either side the top portion of each of the second leg members;

an upper cradle for receiving an upper reinforcement bar, the upper cradle comprising:

a first upper bar-support member having a pair of opposing first upper sidewalls separated by an upper channel;

a second upper bar-support member having a pair of opposing second upper sidewalls separated by the upper channel; and upper edge brace portions that connect the first and second upper sidewalls to the first shoulder members of the first leg members; and a lower cradle attached to the second leg members for receiving a lower reinforcement bar, the lower cradle comprising:

a first lower bar-support member having a pair of opposing first lower sidewalls separated by a lower channel, one of the first lower sidewalls attached to an adjacent one of the first upper sidewalls, and another of the first lower sidewalls attached to an adjacent one of the second upper sidewalls;

a second lower bar-support member having a pair of opposing second lower sidewalls separated by the lower channel, one of the second lower sidewalls attached to an adjacent one of the first upper sidewalls, and another of the second lower sidewalls attached to an adjacent one of the second upper sidewalls; and lower edge brace portions that connect the first and second lower sidewalls to the second shoulder members of the second leg members.

17. The apparatus of claim 16 wherein the upper edge brace portions comprise first upper edge brace portions that connect outer edges of the first and second upper sidewalls to the shoulder members of the first leg members.

18. The apparatus of claim 16 wherein the upper edge brace portions comprise second upper edge brace portions that connect lower edges of the first and second upper sidewalls to the shoulder members of the first leg members.

19. The apparatus of claim 16 wherein the lower edge brace portions comprise first lower edge brace portions that connect outer edges of the first and second lower sidewalls to the shoulder members of the second leg members.

20. The apparatus of claim 16 wherein the lower edge brace portions comprise second lower edge brace portions that connect lower edges of the first and second lower sidewalls to the shoulder members of the second leg members.

21. The apparatus of claim 16 wherein the base member, first and second leg members, upper cradle, lower cradle, upper edge brace portions and lower edge brace portions comprise a unitary structural element.

22. The apparatus of claim 16 wherein the base member, first and second leg members, upper cradle, lower cradle, upper edge brace portions and lower edge brace portions are formed from a continuous piece of thermoplastic material.

* * * * *